US005742949A

United States Patent [19]

Goldi et al.

[11] Patent Number: 5,742,949

[45] Date of Patent: Apr. 28, 1998

[54] TOILET SEAT LOWERING APPARATUS

[76] Inventors: Emil Goldi, 405 Tempe Crescent, North Vancouver, British Columbia, Canada, V7N 1E7; Werner E. Pfisterer, 9267 Emerald Drive, Whistler, British Columbia, Canada, V0N 1B9

[21] Appl. No.: 669,031

[22] Filed: Jun. 17, 1996

[51] Int. Cl.[6] ..... A47K 13/10

[52] U.S. Cl. ..... 4/246.2

[58] Field of Search ..... 4/246.2, 248, 246.1

[56] References Cited

U.S. PATENT DOCUMENTS

| | | | |
|---|---|---|---|
| 765,643 | 7/1904 | Tregoning | 4/248 |
| 1,031,876 | 7/1912 | Schossow | 4/248 |
| 1,863,682 | 6/1932 | Alberts | 4/246.3 |
| 3,781,924 | 1/1974 | Davis, Jr. . | |
| 4,433,442 | 2/1984 | Liou . | |
| 4,887,322 | 12/1989 | Lydon . | |
| 5,103,506 | 4/1992 | Munford . | |
| 5,123,124 | 6/1992 | Brower . | |
| 5,138,724 | 8/1992 | Chien . | |
| 5,177,818 | 1/1993 | Tsai . | |
| 5,193,230 | 3/1993 | Guerty . | |
| 5,222,260 | 6/1993 | Piper . | |
| 5,237,708 | 8/1993 | Zamoyski . | |
| 5,255,396 | 10/1993 | Miyahara . | |
| 5,267,356 | 12/1993 | Gideon . | |
| 5,279,000 | 1/1994 | Mercier . | |
| 5,280,653 | 1/1994 | Tsai . | |
| 5,291,618 | 3/1994 | Chiang . | |
| 5,307,524 | 5/1994 | Veal . | |
| 5,319,810 | 6/1994 | Metzger . | |
| 5,327,589 | 7/1994 | Rice . | |
| 5,343,571 | 9/1994 | Guerty . | |
| 5,369,814 | 12/1994 | Denys . | |
| 5,388,281 | 2/1995 | Wiklund . | |
| 5,400,442 | 3/1995 | Pendlebury . | |
| 5,488,744 | 2/1996 | Paananen | 4/246.2 |

FOREIGN PATENT DOCUMENTS

| | | | |
|---|---|---|---|
| 0145602 | 3/1952 | Australia | 4/264.2 |

*Primary Examiner*—Charles E. Phillips
*Attorney, Agent, or Firm*—Oyen Wiggs Green & Mutala

[57] ABSTRACT

A toilet seat lowering apparatus automatically lowers a toilet seat from an upright position to a lowered position. The apparatus has a base which can be fitted onto an existing toilet. A fluid-containing housing is attached to the base, and a piston is contained within the housing. A piston rod which extends upwardly through the top of the housing is coupled to an arm attached to the toilet seat by an adjustable connecting rod assembly. A conduit formed external to the housing allows fluid to flow between chambers within the housing in response to pressure differentials between the chambers. The rate of flow of fluid and the speed at which the seat is lowered by gravity can be adjusted by the user. The seat can also be quickly manually lifted or lowered.

4 Claims, 4 Drawing Sheets

TOILET SEAT LOWERING APPARATUS

FIELD OF THE INVENTION

This invention pertains to toilet seats, and more particularly to an apparatus for automatically lowering the toilet seat of a toilet from a raised position to a lowered position.

BACKGROUND OF THE INVENTION

Toilet seats can generally be raised or lowered depending on the toilet user's needs and preferences. Men will usually use a toilet with the toilet seat in either the raised or lowered positions. However, women will usually use toilets only with the toilet seat lowered.

In many households, those who use the household toilet only with the seat in a lowered position often demand that the toilet seat be maintained in that position. This may not, however, always be accomplished. Many attempts have been made to alleviate the problem of "leaving the toilet seat up".

In particular, a number of devices have been proposed for automatically raising and lowering a toilet seat. Some of these devices are foot activated. Others are actuated by the flushing of the toilet. For example, U.S. Pat. No. 4,433,442, issued 28 Feb., 1984 for an invention of Liou provides one such toilet seat raising and lowering device. This device is actuated by the movement of a float member contained within the tank of a toilet. Some prior art devices even use electric motors, which may not be particularly safe in the wet environment of a bathroom.

U.S. Pat. No. 5,237,708 issued 24 Aug. 1993 for an invention of Zamoyski proposes a toilet seat lifting and lowering device. Zamoyski's device is foot actuated, and has a pneumatic device attached between a foot-operated lever and the toilet seat.

U.S. Pat. No. 5,103,506 issued 14 Apr., 1992 for an invention of Munford et al. provides a toilet seat lifting apparatus which has a compression spring for providing raising torque to the seat to prevent slamming of the seat against the toilet bowl.

U.S. Pat. No. 3,781,924 issued 1 Jan., 1974 for an invention of Davis, Jr. provides a somewhat complicated toilet seat lowering apparatus actuated by the flushing of the toilet.

Other toilet seat lifting or lowering devices are disclosed in the following United States patents, which are identified by U.S. Pat. Nos. 4,887,322, 5,138,724, 5,193,230, 5,222,260, 5,267,356, 5,279,000, 5,291,618, 5,307,524, 5,327,589, 5,343,571, 5,369,814, 5,388,281, and 5,400,442.

Few prior art devices, however, appear to have been accepted by consumers. This may be due to the complexity, cumbersomeness, cost and/or unattractive appearance of such devices.

The present invention provides a relatively simple, aesthetically pleasing apparatus for automatically lowering a toilet seat within a few minutes after use. The apparatus can be inexpensively manufactured and can easily be retrofitted onto an existing toilet.

SUMMARY OF THE INVENTION

The invention provides an apparatus for automatically lowering a toilet seat from a raised position to a lowered position. A bracket mounts the apparatus onto the base of a toilet. A fluid-containing piston housing is attached to the mounting bracket. The piston forms first and second chambers within the housing, and is reciprocable between an upper position near the top of the housing, and a lower position near the bottom of the housing. A piston rod is connected to the piston and extends upwardly through the top of the housing. An arm is mounted on the underside of the toilet seat near the hinge which attaches the toilet seat to the toilet bowl, and is linked to the piston rod.

A fluid flow conduit external to the housing communicates with the chambers. Fluid contained within the housing moves through the conduit from the upper chamber to the lower chamber as the piston is moved upwardly, and vice versa as the piston is moved downwardly. An adjustable valve is provided in the conduit for regulating the rate of flow of fluid through the conduit.

Valves may be provided in the piston itself to allow a relatively large volume of fluid to flow rapidly between the two chambers when large pressure differences between the chambers are developed by manual raising or lowering of the toilet seat.

BRIEF DESCRIPTION OF THE DRAWINGS

In drawings which illustrate various embodiments of the invention.

DETAILED DESCRIPTION OF THE PREFERRED EMBODIMENT

Figure 1:
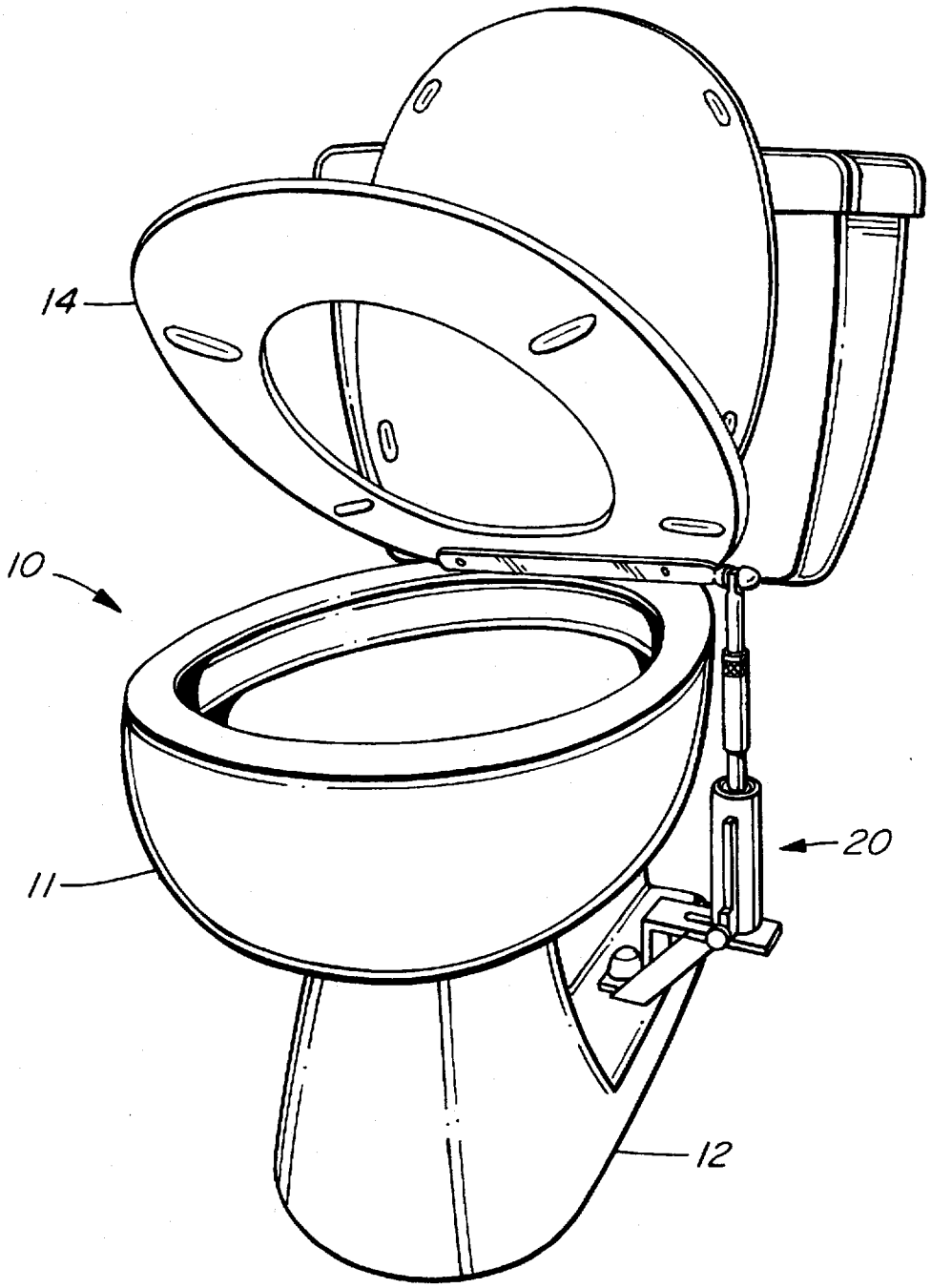
FIG. 1 is a perspective view of a toilet and toilet seat to which a toilet seat lowering apparatus made in accordance with one embodiment of the invention is attached.

FIG. 1 shows a conventional toilet 10 having a base 12, a bowl 11, and a toilet seat 14 attached to bowl 11 by a hinge (not shown). A toilet seat lowering apparatus (generally indicated by reference numeral 20) made in accordance with the invention is shown in FIG. 1 attached to toilet 10. Lowering apparatus 20 is attached to both base 12 and seat 14 of toilet 10.

Figure 2:
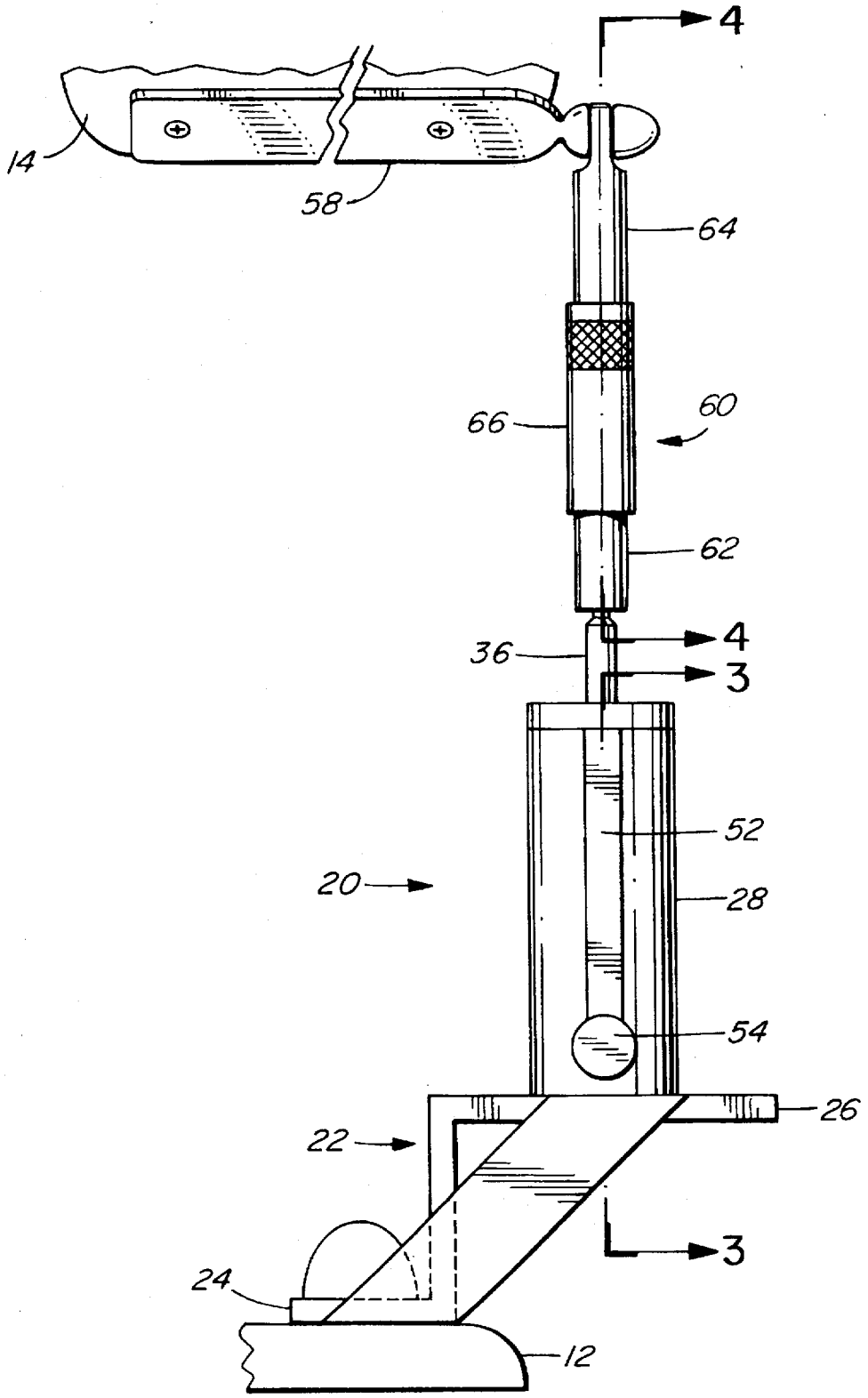
FIG. 2 is an enlarged front plan view of the toilet seat lowering apparatus illustrated in FIG. 1.

Referring to FIG. 2, toilet seat lowering apparatus 20 is attached to base 12 of toilet 10 by mounting bracket 22. Mounting bracket 22 is conveniently held in place by the same bolts (shown covered in FIGS. 1 and 2) by which toilet 10 is bolted to the floor. Mounting bracket 22 has a first plate 24 for attachment to base 12 and a second plate 26 to which a housing 28 is attached.

Figure 3:
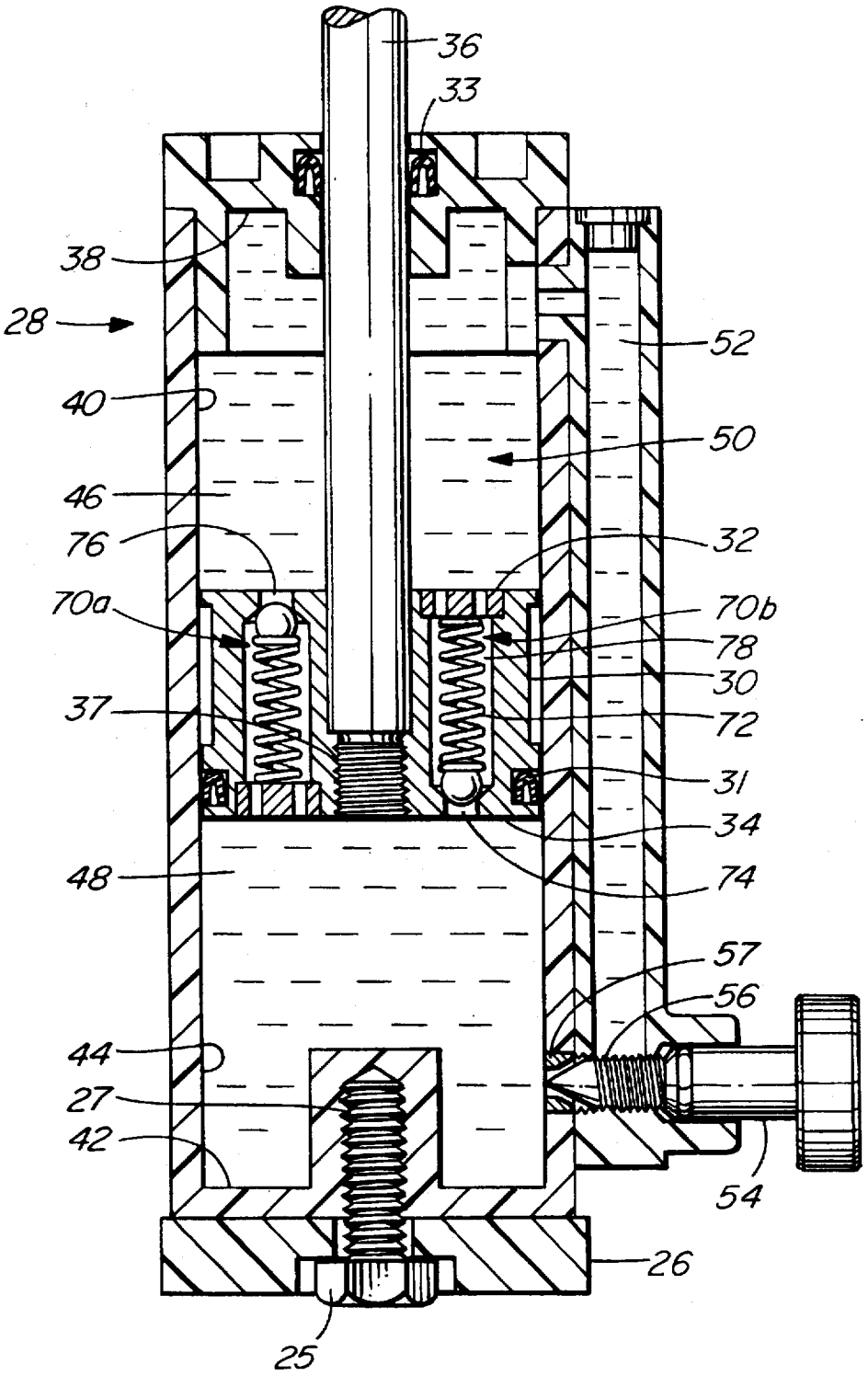
FIG. 3 is a cross-sectional view of a portion of the apparatus of FIG. 2 taken along lines 3—3 of FIG. 2.

As shown in FIG. 3, housing 28 is attached to second plate 26 by bolt 25 which passes through an elongate slot (not shown) formed in second plate 26. Bolt 25 threadably engages bore 27 formed in the bottom of housing 28. The slot allows lateral adjustment of housing 28 relative toilet base 12. Housing 28 is preferably cylindrical and contains a viscous fluid 50, preferably oil.

A piston 30 is contained within housing 28, and is preferably cylindrical. Piston 30 has an upper surface 32 and a lower surface 34. Piston rod 36 is threadably attached to piston 30 and extends upwardly through the top of housing 28. A piston ring 31, preferably a "U"-ring, encircles piston 30 to improve the seal between piston 30 and housing 28. A second "U"-ring 33 circumferentially seals rod 36 near the top of housing 28 to prevent fluid 50 contained within housing 28 from escaping housing 28 where rod 36 emerges from therefrom.

Housing 28 has an interior top surface 38, an upper interior side surface 40, an interior bottom surface 42 and a lower interior side surface 44. An upper chamber 46 is defined within housing 28 by piston upper surface 32, interior top surface 38 and upper interior side surface 40. A lower chamber 48 is defined within housing 28 by piston lower surface 34, interior bottom surface 42 and lower interior side surface 44.

Piston 30 is reciprocable within housing 28 between upper and lower positions. Conduit 52 communicates between chambers 46, 48 allowing fluid 50 to pass from chamber 46 to chamber 48, and vice versa, as piston 30 is reciprocated. Conduit 52 may be external to housing 28, as shown in FIG. 3.

If piston 30 moves upwardly relative to housing 28, the hydraulic pressure in upper chamber 46 increases relative to that in lower chamber 48, forcing fluid 50 from upper chamber 46 through conduit 52 to lower chamber 48. If piston 30 moves downwardly relative housing 28, fluid 50 is forced from lower chamber 48 through conduit 52 to upper chamber 46.

The rate of flow of fluid 50 through conduit 52 depends on the pressure differential between chambers 46 and 48. The rate of flow of fluid 50 through conduit 52 may be restricted by decreasing the cross sectional area of conduit 52 at any point therein. Accordingly, the rate of flow of fluid 50 may be adjusted by means of flow adjusting valve 54 which is capable of changing the cross sectional area of conduit 52 at aperture 57 where conduit 52 intersects chamber 48.

Flow adjusting valve 54 may comprise a tapered pin 56 threadably engaged within conduit 52 for advancement or retraction relative to aperture 57. The rate of flow of fluid 50 is reduced by threadably advancing pin 56 into aperture 57, thereby reducing the open cross-sectional area of conduit 52. Conversely, the rate of flow of fluid 50 is increased by threadably retracting pin 56 from aperture 57, increasing the open cross-sectional area of conduit 52. If pin 56 is allowed to completely close aperture 57, fluid 50 is prevented from flowing through conduit 52.

Figure 4:
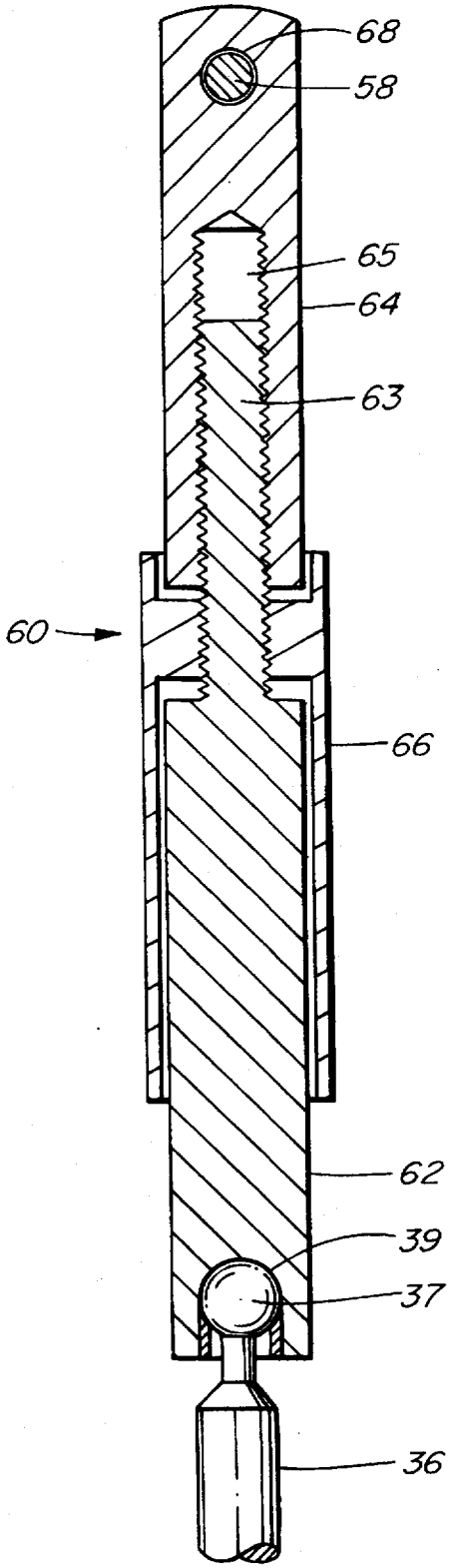
FIG. 4 is a cross-sectional view of a portion of the apparatus of FIG. 2 taken along lines 4—4 of FIG. 2.

Arm 58 is attached to the underside of toilet seat 14 by screws, as shown in FIG. 2. Rod 36 is coupled to arm 58 by coupling means, preferably an adjustable coupling rod assembly 60 as shown in FIGS. 2 and 4. When toilet seat 14 is in the raised position, piston 30 is in its upper position. Piston 30 is in its lower position when toilet seat 14 is lowered.

When toilet seat 14 is in a raised position, but not vertical, the force of gravity acts on toilet seat 14, urging seat 14 to its lowered position. The downward gravitational force on seat 14 is transferred through arm 58, coupling rod assembly 60 and piston rod 36 to urge piston 30 downwardly within housing 28. If aperture 57 is not closed, the downward force on piston 30 expels fluid from chamber 48 through conduit 52 to chamber 46. The speed with which seat 14 is lowered from a raised position to a lowered position depends on the rate of flow of fluid 50, which is adjusted by means of valve 54, as described above. More particularly, seat 14 lowers slowly when pin 56 is advanced significantly into aperture 57, and more quickly as pin 56 is retracted from aperture 57. Valve 54 can be adjusted to the user's preference; typically, valve 54 is adjusted so that seat 14 returns to a lowered position from a raised position within a few minutes.

Because forces stronger than the force of gravity may act on toilet seat 14, for example, when the seat is manually raised or lowered, high pressure release valves **70*a*, 70*b* are provided within piston 30, to allow fluid 50 to flow between chambers 46, 48 through piston 30 in response to high pressure differentials between chambers 46, 48**.

Pressure release valves **70*a*, 70*b* each comprise a conduit 78 formed through piston 30 and a spring 72 and ball 74 arrangement. Spring 72 normally urges ball 74 into ball socket 76, preventing fluid flow through conduit 78**.

Normally, when the pressure differential between chambers 46, 48 is not great, for example, when the only force on piston 30 is the force of gravity, fluid 50 will flow between chambers 46, 48 only through conduit 52. The rate of flow of fluid 50 in this case will be low. But if there is a significant pressure differential between chambers 46, 48, for example, when piston 30 is quickly forced downwardly by manual lowering of toilet seat 14, the high pressure in chamber 48 will cause ball 74 to be displaced from its socket 76, allowing fluid 50 to pass from chamber 48 through conduit 78 to chamber 46.

Pressure release valve **70*a* allows fluid to flow from upper chamber 46 to lower chamber 48, while release valve 70*b* allows fluid to flow from lower chamber 48 to upper chamber 46**, when predefined pressure differentials are developed.

When release valve **70*a* or release valve 70*b* is opened by a high pressure, the rate of flow of fluid 50 through piston conduit 78 is higher than the rate of flow through conduit 52. The predetermined pressure at which ball 74 is displaced from socket 76 depends on the urging force provided by spring 72. To prevent opening of valves 70*a* and 70*b* when only the force of gravity is acting on toilet seat 14, spring 72 should be strong enough to allow ball 74 to be displaced from socket 76 only when a force greater than the force of gravity is applied to toilet seat 14. Spring 72 used in each of valves 70*a* and 70*b*** may have different strengths.

Connecting rod assembly 60 incorporates a lower connecting rod 62 attached to rod 36, and an upper connecting rod 64 attached to arm 58. Upper connecting rod 64 may have an aperture 68 formed therethrough for pivotally engaging a pin (not shown) on one end of arm 58.

Preferably, the length of connecting rod assembly 60 is adjustable. This may be conveniently accomplished by providing a threaded portion 63 on lower connecting rod 62, a mating threaded bore 65 on upper connecting rod 64, and threading connecting rods 62, 64 together. The further upper connecting rod 64 is threaded onto lower connecting rod 62, the shorter connecting rod assembly 60 will be. The length of connecting rod assembly 60 is appropriately adjusted to allow bracket 22 to be attached to toilet base 12 and arm 58 to be attached to toilet seat 14 with seat 14 in the raised position and piston 30 in its upper position.

A sleeve 66 (FIG. 4) may also be threaded onto threaded portion 63 on lower connecting rod 62. Sleeve 66 "locks" upper connecting rod 64 into place by preventing the threading of upper connecting rod 64 onto lower connecting rod 62 beyond a predetermined point, and also conveniently serves to hide the length of threaded portion 63 which is not contained within threaded bore 65 of upper connecting rod 64 when connecting rods 62, 64 are threaded together.

Rod 36 may have a ball-shaped head 37 formed at its upper end. Lower connecting rod 62 is coupled to rod 36 by engaging head 37 in head-engaging socket 39 formed within the lower end of lower connecting rod 62. This allows connecting rod assembly 60 to pivot around head 37 and allows connecting rod assembly 60 to be in other than axial alignment with rod 36, the importance of which will be discussed below.

When retrofitting an existing toilet with toilet seat lowering apparatus 20, first plate 24 is fitted onto the bolts by which toilet 10 is held in place. Seat 14 is lifted, and arm 58 is screwed onto the underside of toilet seat 14. The length of connecting rod assembly 60 is adjusted such that when arm 58 is attached to the underside of seat 14, piston 30 is at or near the top of housing 28.

In operation, when the user of toilet 10 raises seat 14 to a raised position by hand, arm 58, connecting assembly 60, rod 36 and piston 30 are also lifted. As seat 14 is lifted, arm 58 also rotates relative base 12 of toilet 10, and pin (not shown) engaged within aperture 68 of upper connecting rod 64 pivots within aperture 68. As arm 58 is lifted and rotated, arm 58 moves not only upwardly, but also backward relative the front of toilet base 10. As arm 58 is lifted, connecting rod assembly 60, originally axially aligned with rod 36, pivots on ball-shaped head 37 relative the longitudinal axis of rod 36 and leans backward to follow arm 58. The length of connecting rod assembly 60 is adjusted so that toilet seat 14 cannot be lifted to the vertical plane.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Apparatus for lowering a toilet seat from a raised position to a lowered position, said apparatus comprising:

a) a bracket attachable to a base of a toilet;

b a housing attached to said bracket, said housing containing a fluid;

c) a reciprocable piston contained within said housing to form first and second chambers within said housing;

d) a piston rod connected to said piston and extending upwardly through a top portion of said housing;

e) an arm mountable on the underside of said toilet seat;

f) a connecting rod assembly for connecting said piston rod to said arm, said rod assembly having a lower end attachable to a top portion of said piston rod, and an upper end attachable to said arm, wherein said connecting rod assembly has an adjustable length and wherein said connecting rod assembly further comprises a first connecting member having a threaded portion and a second connecting member axially threadable onto said first connecting member threaded portion;

g) a fluid flow conduit communicating between said first and second chambers, wherein said conduit is external said housing;

h) a first valve for regulating the rate of fluid flow between said first and second chambers;

i) a second normally closed valve in said piston, said second valve openable in response to a predefined fluid pressure in said first chamber for allowing fluid flow through said piston from said first chamber to said second chamber, wherein said second valve comprises a first conduit formed through said piston, a socket formed at an end of said first conduit communicating with said first chamber, and a ball normally urged into said socket by a spring;

j) a third normally closed valve in said piston, said third valve openable in response to a predefined fluid pressure in said second chamber for allowing flow of said fluid through said piston from said second chamber to said first chamber, wherein said third valve comprises a second conduit formed through said piston, a socket formed at an end of said second conduit communicating with said second chamber, and a ball normally urged into said socket by a spring; and, k) locking means for maintaining said connecting rod assembly at a predetermined length.

2. Apparatus as defined in claim 1, wherein one end of said connecting rod assembly is pivotally connected to said piston rod top portion, and an opposed end of said connecting rod assembly is pivotally connected to said arm.

3. Apparatus as defined in claim 2, wherein said piston rod top portion comprises a ball-shaped member and said one end of said connecting rod assembly comprises a socket for pivotally engaging said ball-shaped member.

4. Apparatus as defined in claim 3, wherein said housing and said piston are cylindrical.

* * * * *